US010129931B2

(12) United States Patent
McIver et al.

(10) Patent No.: US 10,129,931 B2
(45) Date of Patent: Nov. 13, 2018

(54) ELECTRICAL RESISTANCE HEATING ELEMENT

(75) Inventors: Martin McIver, Perthshire (GB); Helen Seaton, Perth (GB); Stanley Moug, Perth (GB); John Beatson, Perth (GB)

(73) Assignee: SANDVIK MATERIALS TECHNOLOGY UK LIMITED (GB)

( * ) Notice: Subject to any disclaimer, the term of this patent is extended or adjusted under 35 U.S.C. 154(b) by 1086 days.

(21) Appl. No.: 12/996,550

(22) PCT Filed: Jun. 3, 2009

(86) PCT No.: PCT/GB2009/050618

§ 371 (c)(1),
(2), (4) Date: Dec. 6, 2010

(87) PCT Pub. No.: WO2009/147436

PCT Pub. Date: Dec. 10, 2009

(65) Prior Publication Data

US 2011/0089161 A1 Apr. 21, 2011

Related U.S. Application Data

(60) Provisional application No. 61/129,178, filed on Jun. 9, 2008.

(30) Foreign Application Priority Data

Jun. 6, 2008 (GB) ..... 0810406.9

(51) Int. Cl.

| | |
|---|---|
| ***H05B 3/10*** | (2006.01) |
| ***H05B 3/14*** | (2006.01) |
| ***H05B 3/42*** | (2006.01) |

(52) U.S. Cl.
CPC ..... *H05B 3/148* (2013.01); *H05B 3/42* (2013.01); *H05B 3/14* (2013.01)

(58) Field of Classification Search
CPC . H05B 3/14; H05B 3/148; H05B 3/10; H05B 3/40; H05B 3/44; H05B 3/46;
(Continued)

(56) References Cited

U.S. PATENT DOCUMENTS 650,234 A 5/1900 Fitzgerald
1,818,191 A * 8/1931 Boyer ..... 338/318
(Continued)

FOREIGN PATENT DOCUMENTS

GB 513728 A 10/1939
GB 845496 8/1960
(Continued)

OTHER PUBLICATIONS

Baumann, Jr., H., *The Relationship of Alpha and Beta Silicon Carbide*, J. Electrochem. Soc., Mar. 1952 ISSN:0013-4651, pp. 109-114.
(Continued)

*Primary Examiner* — Diallo I Duniver
(74) *Attorney, Agent, or Firm* — Clocktower Law; Erik J. Heels; Michael A. Bartley

(57) ABSTRACT

A silicon carbide heating element is provided having one or more hot zones and two or more cold ends in which:—
the cross-sectional areas of the two or more cold ends are substantially the same or less than the cross-sectional areas of the one or more hot zones; and
part at least of at least one cold end comprises a body of recrystallized silicon carbide material coated with a conductive coating having an electrical resistivity lower than that of the recrystallized silicon carbide material.

19 Claims, 7 Drawing Sheets

7a)

7b)

(58) Field of Classification Search
CPC ... H05B 3/48; H05B 3/42; H01C 7/18; H01C 7/00; H01C 7/22; F27D 2099/0011; F27D 11/00; F27D 11/02; F27D 11/04
USPC ..... 219/553, 462.1, 552, 546–549, 461.1, 219/460.1, 538; 338/306–314; 373/111, 373/117, 132–134
See application file for complete search history.

(56) References Cited

U.S. PATENT DOCUMENTS

| | | | | | |
|---|---|---|---|---|---|
| 2,319,323 | A | * | 5/1943 | Heyroth | 338/329 |
| 2,431,326 | A | | 11/1947 | Heyroth | |
| 2,546,142 | A | | 3/1951 | Watson | |
| 3,094,679 | A | * | 6/1963 | O'Connor et al. | 338/330 |
| 3,307,136 | A | * | 2/1967 | Fitzer et al. | 338/322 |
| 3,372,305 | A | * | 3/1968 | Mikulec | 219/267 |
| 3,875,477 | A | * | 4/1975 | Fredriksson et al. | 361/264 |
| 3,964,943 | A | * | 6/1976 | Andersen | F23Q 7/22 216/101 |
| 4,241,292 | A | * | 12/1980 | Kreick et al. | 219/541 |
| 4,260,872 | A | | 4/1981 | Brodmann et al. | |
| 4,555,358 | A | | 11/1985 | Matsushita et al. | |
| 4,610,934 | A | * | 9/1986 | Boecker | C04B 37/026 228/122.1 |
| 5,139,594 | A | * | 8/1992 | Rabin | 156/89.25 |
| 5,322,824 | A | * | 6/1994 | Chia | 501/89 |
| 6,090,733 | A | | 7/2000 | Otsuki et al. | |
| 6,214,755 | B1 | | 4/2001 | Otsuki et al. | |
| 6,616,890 | B2 | * | 9/2003 | McPhillips | 264/642 |
| 2006/0061020 | A1 | | 3/2006 | Wynn et al. | |
| 2006/0198420 | A1 | * | 9/2006 | Beatson | 373/117 |

FOREIGN PATENT DOCUMENTS

| | | | | | |
|---|---|---|---|---|---|
| GB | 989502 | | 4/1965 | | |
| GB | 1279478 | | 6/1972 | | |
| GB | 1423136 | | 1/1976 | | |
| GB | 1459252 | | 12/1976 | | |
| GB | 2307384 | A | 5/1997 | | |
| JP | 1100888 | | 10/1987 | | |
| JP | 4230985 | A | 8/1992 | | |
| JP | 5315056 | A | 11/1993 | | |
| JP | 3639998 | B2 | 2/1995 | | |
| JP | 9255428 | A | 3/1996 | | |
| JP | 9213462 | A | 8/1997 | | |
| JP | 10302940 | A | 11/1998 | | |
| JP | 2000048936 | A | 2/2000 | | |
| JP | 2002338366 | A | 11/2002 | | |
| JP | 2003073168 | A | 3/2003 | | |
| JP | 2003277929 | A | 10/2003 | | |
| JP | 2003327478 | A | 11/2003 | | |
| JP | 2005-149973 | A | 6/2005 | | |
| JP | 2005149973 | A | * | 6/2005 | H05B 3/14 |
| WO | 9512093 | A2 | 5/1995 | | |
| WO | 03017723 | A2 | 2/2003 | | |

OTHER PUBLICATIONS

International Search Report dated Sep. 9, 2009 for International Application No. PCT/GB2009/050618.

International Preliminary Report on Patentability dated Sep. 13, 2010 International Application No. PCT/GB2009/050618.

Erema, Erema Heating Element Model, webpage, captured Jan. 10, 2007, online publication at www.tokaikonetsu.co.jp/english/products/en_erema_h_01.html, Japan.

Silcarb, Silicon Carbide Heating Elements, webpage, captured Jan. 10, 2007, online publication at www.silcarbindia.com/heating.htm, India.

Songshan Enterprise Group, SiC Heating Elements (heater), webpage, captured Jan. 10, 2007, online publication at songshan.en.ec21.com/print_product_detail.jps?group_id=2&product_id=1, China.

Squared R Element Co, U, W, and Y—Multiple Leg Starbars, Silicon Carbide Heating Elements, technical brochure, captured Jan. 10, 2007, online publication at www.isquaredrelement.com/pdf/uwy%20brochure.pdf, Akron, NY, US.

Squared R Element Co, I2R, product brochure, 2007, online publication at www.readbag.com/isquaredrelement-pdf-product-overview, Akron, NY, US.

* cited by examiner

7a)

7b)

ELECTRICAL RESISTANCE HEATING ELEMENT

BACKGROUND

1. Field

Disclosed herein are electrical resistance heating elements, more particularly to silicon carbide electrical heating elements.

2. Description of Related Art

Silicon carbide heating elements are well known in the field of electrical heating elements and electric furnaces. Conventional silicon carbide heating elements comprise predominantly silicon carbide and may include some silicon, carbon, and other components in minor amounts. Conventionally, silicon carbide heating elements are in the form of solid rods, tubular rods, or helical cut tubular rods, although other forms such as strip elements are known. The present invention is not restricted to a particular shape of the elements.

Silicon carbide electrical heating elements comprise parts commonly known as 'cold ends' and 'hot zones' which are differentiated by their relative resistance to electrical current. There may be a single hot zone or more than one hot zone [for example in three phase elements (such as in GB 845496 and GB 1279478)].

A typical silicon carbide heating element has a single hot zone having a relatively high resistance per unit length, and at either end of the hot zone, cold ends having a relatively low resistance per unit length. This results in a majority of the heat being generated from the hot zones when a current is passed through the element. The 'cold ends' by virtue of their relatively lower resistance generate less heat and are used to support the heating element in the furnace and to connect to an electrical supply from which the electrical energy is supplied to the hot zone.

In the claims and in the following description the term "silicon carbide heating element" should be taken as meaning (except where the context demands otherwise) a body comprising predominantly silicon carbide and comprising one or more hot zones and two or more cold ends.

Frequently, the cold ends comprise a metallised terminal end portion remote from the hot zone so to assist good electrical connectivity with the electrical supply. Conventionally, electrical connection to the cold ends is by flat aluminium braids held in compression around the circumference of the terminal end by a stainless steel clamp or clip. The cold ends in operation have a gradient of temperature along their length, from operating temperature of the hot zone where the cold ends join the hot zone, through to close to room temperature at the terminal ends.

One of the earliest heating element designs was in the form of a dumbbell shaped element in which the cold ends were made of the same material as the hot zone but having a larger cross section than the hot zone. Typically, the electrical resistance per unit length ratio of the cold end to the hot zones for such heating elements was about 3:1.

An alternative approach is, in effect, to wrap a dumbbell shaped element into a single or double helix. Such a geometry is obtained by helically cutting part of a tubular rod. Typical rods of this type are Crusilite® Type X elements and Globar® SG (a single helix element) or SR (a double helix element) rods.

An alternative approach is to use lower resistivity materials to form the cold ends and higher resistivity material to form the hot zone. Known methods to produce the lower resistivity material include by impregnation of the pore structure of the ends of a silicon carbide body with silicon metal by a process known as siliconising.

GB513728 (The Carborundum Company) disclosed a joining technique in which materials of different resistivity are bonded by applying a carbonaceous cement at the joint and heating so that excess silicon in the cold ends permeates to the joint between the cold ends and the hot zone thereby reacting with carbon in the cement to form a silicon carbide bond. By these methods, the electrical resistance per unit length ratio of the cold end to the hot zone can be increased to about 15:1.

JP2005149973 (Tokai Konetsu Kogyo KK) discussed alleged problems in migration of silicon from the cold ends to the hot zone, and disclosed the addition of molybdenum disilicide to the material of the cold end to prevent this migration and improve the strength at the cold ends/hot zone interface. A five part construction is revealed in which a hot zone of recrystallised silicon carbide is bracketed by a $MoSi_2$/SiC composite and then a SiC/Si composite. This arrangement had as a consequence lowering of the resistivity of the cold end, so improving efficiency.

SUMMARY

Whilst such techniques offer an increased electrical resistance ratio, the increase in cost of the raw materials, and the complexity of multiple joins in materials, leads to high cost.

With increasing environmental concern over global warming, and increasing energy prices, many energy intensive industries utilizing electrical heating furnaces need to reduce their energy usage by cost effective means.

Improvements such as improved insulation of the furnace to prevent excessive heat loss have played a major role in reducing the energy consumption. However, little has been done to improve the energy efficiency of the elements in a cost effective manner. The applicant has explored a number of approaches that separately, or in combination, provide a cost effective increase in resistance ratios, and hence decreased energy use.

In a first approach, the present applicant looked to mitigate the above problems based on the realisation that the difference in electrical conductivity between β-silicon carbide and α-silicon carbide can be used to reduce the resistivity of the material of the cold end, leading to a reduction in the resistance per unit of the cold end, and consequently a reduction in power consumption.

Of the many polymorphic forms of silicon carbide, the two of interest which influence the characteristics of heating element cold ends are α-silicon carbide (SiC 6H) which has a hexagonal crystal structure and β-silicon carbide (SiC 3C) which has a face-centred cubic structure.

Baumann "*The Relationship of Alpha and Beta Silicon Carbide*", Journal of the Electrochemical Society, 1952 ISSN:0013-4651, discusses the formation of silicon carbide and noted that primary (i.e. first to form) silicon carbide was β-silicon carbide at all temperatures studied.

However Bauman noted that:—

> "Beta SiC begins to transform monotropically to alpha SiC slowly at 2100° C. It changes to the alpha form rapidly and completely at 2400° C."

It is known that nitrogen acts as a dopant in silicon carbide that has the effect of reducing electrical resistivity.

Typical electrical resistivities of commonly produced heating element materials consisting of two polymorphic types of silicon carbide are summarised in Table 1 below, which shows that β-silicon carbide has a much lower electrical resistivity than α-silicon carbide.

Typically hot zones are formed from either recrystallised silicon carbide which has the characteristics of being a compact self-bonded silicon carbide matrix with open porosity or from more dense reaction bonded material which has been recrystallised. Such materials are almost entirely α-silicon carbide and in comparison with silicon impregnated material have a relatively low thermal conductivity and a relatively low electrical conductivity.

These resistivity values are for commercially produced materials—typically for recrystallised α-silicon carbide rods or tubes and also for single piece β-silicon carbide tubes made by lower temperature transformation of carbon to silicon carbide by reaction of carbon tubes with silicon dioxide and coke powder mixtures [CRUSILITE® elements].

TABLE 1

| | α-silicon carbide (nitrogen doped) | β-silicon carbide (nitrogen doped) |
|---|---|---|
| Electrical resistivity | 0.070-0.100 Ω · cm | 0.007-0.01 Ω · cm |

The high firing temperature traditionally used in siliconising the cold end predominantly results in the formation of a high proportion of a silicon carbide from silicon and carbon present.

Since, α-silicon carbide starts to form at temperatures above 2100° C., one could assume that lowering the siliconising temperature would promote β-silicon carbide rather than α-silicon carbide. However, in order to achieve full infiltration and conversion of the green material, the silicon dioxide present on the surface of the silicon metal and silicon carbide grains has to be removed. In order to do this, a temperature in excess of 2150° C. is required. Tests at siliconising temperatures around 1900° C.-2000° C. result in poor infiltration of the green material with silicon, a lower yield of secondary silicon carbide giving low mechanical strength, unreacted carbon and high resistance. Processing at such temperatures results in poorly reacted product because the silicon dioxide has not been removed. The applicants have found means to promote the formation of β-silicon carbide and so to produce lower resistivity materials for silicon carbide heating elements than previously known in this field [even lower than the conventional β-silicon carbide elements mentioned in Table 1 above].

Accordingly, in this approach, a silicon carbide heating element is provided having one or more hot zones and two or more cold ends, the hot zones comprising a different silicon carbide containing material from the cold ends, and in which the silicon carbide in the material of the cold ends comprises sufficient β-silicon carbide that the material has an electrical resistivity less than 0.002 Ω·cm at 600° C. and less than 0.0015 Ω·cm at 1000° C.

Typical values of less than 0.00135 Ω·cm at 600° C. are readily achievable.

Optionally in this approach (and separately or in combination):

the silicon carbide of the material of the cold end may comprise α-silicon carbide and β-silicon carbide the volume fraction of β-silicon carbide may be greater than the volume fraction of α-silicon carbide;

the ratio of the volume fraction of β-silicon carbide to the volume fraction of α-silicon carbide may be greater than 3:2;

the material of the cold ends may comprise greater than 45 vol % β-silicon carbide the total amount of silicon carbide may be greater than 70 vol %; or indeed above 75%;

the material of the cold end may comprise:—

| | |
|---|---|
| SiC | 70-95 vol % |
| Si | 5-25 vol % |
| C | 0-10 vol % |

with SiC+Si+C making up >95% of the material of the material;

the ratio of the electrical resistivity of the material of the hot zone to the electrical resistivity of the material of the cold end may be greater than 40:1.

To form such an element a method is provided comprising the step of exposing a carbonaceous silicon carbide body comprising silicon carbide and carbon and/or carbon precursors, to silicon at a controlled reaction temperature sufficient to enable the silicon to react with the carbon and/or carbon produced from the carbon precursors to form β-silicon carbide in preference to α-silicon carbide, and for an exposure time sufficient that the amount of β-silicon carbide in the cold end is sufficient that the material has an electrical resistivity less than 0.002 Ω·cm at 600° C. and less than 0.0015 Ω·cm at 1000° C.

Additionally, as well as temperature control, the reaction parameters are controlled to promote β-silicon carbide formation in preference to α-silicon carbide by controlling one or more of the following process variables:— silicon particle size purity levels of the raw materials ramp rate to reaction temperature These variables can be controlled to limit the effect of the exothermic reaction between silicon and carbon which can result in a temperature overrun as discussed in detail below.

By suppressing the formation of α-silicon carbide at the siliconising temperature and increasing the proportion of β-silicon carbide in the bulk material of the cold end, the electrical conductivity can be increased.

It should be noted that atmosphere during siliconising is an important process variable, with a nitrogen atmosphere being preferred. Siliconising under vacuum is possible but the absence of a nitrogen dopant [unless supplied in some other form] yields higher resistivity β-silicon carbide.

By replacing cold ends of existing elements with cold ends made according to this approach an increase in the electrical resistance ratio of the hot zone to cold end can be achieved.

Additionally, if the electrical resistance ratio of the hot zone to cold end of a conventional element is acceptable, use of cold ends made according to this approach permit the use of lower resistance hot zones, leading to a decrease in overall resistance of the element, which can be useful in some applications.

Further, use of cold ends made according to this approach permits the use of lower resistivity hot zones so permitting longer elements to be made of a given overall resistance in comparison with conventional elements.

Use of low resistivity cold end material will allow for thermally beneficial changes to be made to the traditional geometry of cold ends. Since the resistivity of the improved material is much less than conventional materials, it is possible to reduce the cross sectional area of the cold end (for example by up to 50%) while still maintaining ratios of the electrical resistivity of the material of the hot zone to the electrical resistivity of the material of the cold end which are acceptable (eg 30:1).

The wall thickness of elements with standard outer dimension cold ends can be reduced with a consequential reduction in thermal transfer.

However, reducing the cross section by using smaller outer diameter cold ends will result in reduced heat loss through allowing furnace lead in holes to be plugged to smaller dimension. Such reduced outer diameter cold ends may be provided with insulating sleeves. Insulation in this manner will reduce heat loss so raising the temperature of the cold end. As silicon carbide increases in electrical conductivity with increasing temperature this will also serve to keep the resistance of the cold end lower than an uninsulated cold end.

In a second approach, as disclosed herein, a silicon carbide heating element is provided, having one or more hot zones and two or more cold ends, in which:—

- the cross-sectional areas of the two or more cold ends are substantially is the same or less than the cross-sectional areas of the one or more hot zones; and
- part at least of at least one cold end comprises a body of recrystallised silicon carbide material coated with a conductive coating having an electrical resistivity lower than that of the recrystallised silicon carbide material.

In this aspect, the applicant has realised that thermal conductivity of the cold end material is an important factor in determining heat loss and hence energy consumption. By making the cold ends of recrystallised silicon carbide material [which has a lower thermal conductivity than traditional metal impregnated silicon carbide cold ends] heat loss through the cold end can be reduced. Traditionally, recrystallised silicon carbide material would not have been used as a cold end material as having too low an electrical conductivity. The low electrical resistivity coating to the cold end provides a good electrical path, so permitting both high electrical conductivity and low thermal conductivity. A thin coating [e.g. 0.2-0.25 mm] relative to a typical element cross section [e.g. 20 mm] provides adequate electrical conductivity while providing a small path for heat loss and hence low heat transfer. The coating may for example have a thickness of less than 0.5 mm although greater may be acceptable in some applications. The coating thickness may for example be less than 5% or less than 2% of the diameter of the element although greater may be acceptable in some applications. Preferably a self bonded recrystallised silicon carbide material is used, as its porosity gives it a lower thermal conductivity than a reaction bonded material.

The inventor has further realised that the operating temperature of the heating element may be compromised by the limitation in operating temperature of the coated portion of the cold end, and has devised a hybrid construction of element, whereby the coated section of the cold end is displaced from the hot zone by the insertion of a section of lower electrical resistivity material than that of the recrystallised silicon carbide material. This lower electrical resistivity material may be a conventional cold end material [e.g. silicon impregnated silicon carbide]. The section of lower electrical resistivity material may be integral with the element, or may be joined to it, using reaction-bonding or other techniques. The length of this section of cold end material can be varied, according to the total length of the cold end, the operating temperature of the furnace, and the thickness and insulation properties of the thermal lining of the equipment.

In a third, approach, a silicon carbide heating element is provided having one or more hot zones and two or more cold ends, one or more of the cold ends having one or more flexible metallic conductors bonded thereto. [The term "bonded" in this context should be taken to mean joined to form a unitary body and includes. without limitation, such techniques as welding, brazing, soldering, diffusion bonding, and adhesive bonding]

The above three aspects may be used separately or in any combination thereof and may permit:—

- the production of elements having high ratios of the electrical resistance per unit length of the entire hot zone to the entire cold end with consequent reduction in energy requirements
- the production of elements having more normal ratios of the electrical resistance per unit length of the entire hot zone to the entire cold end [e.g. <40:1] but with a lower overall element resistance
- the production of elements having more normal ratios of the electrical resistance per unit length of the entire hot zone to the entire cold end [e.g. <40:1] but of greater length while maintaining overall element resistance
- the production of elements with lower heat loss from the cold ends.

BRIEF DESCRIPTION OF DRAWINGS

The features of the elements described herein will be apparent from the claims and the following illustrative description made with reference to the accompanying drawings in which:—

DETAILED DESCRIPTION OF SPECIFIC EMBODIMENTS

Figure 1:
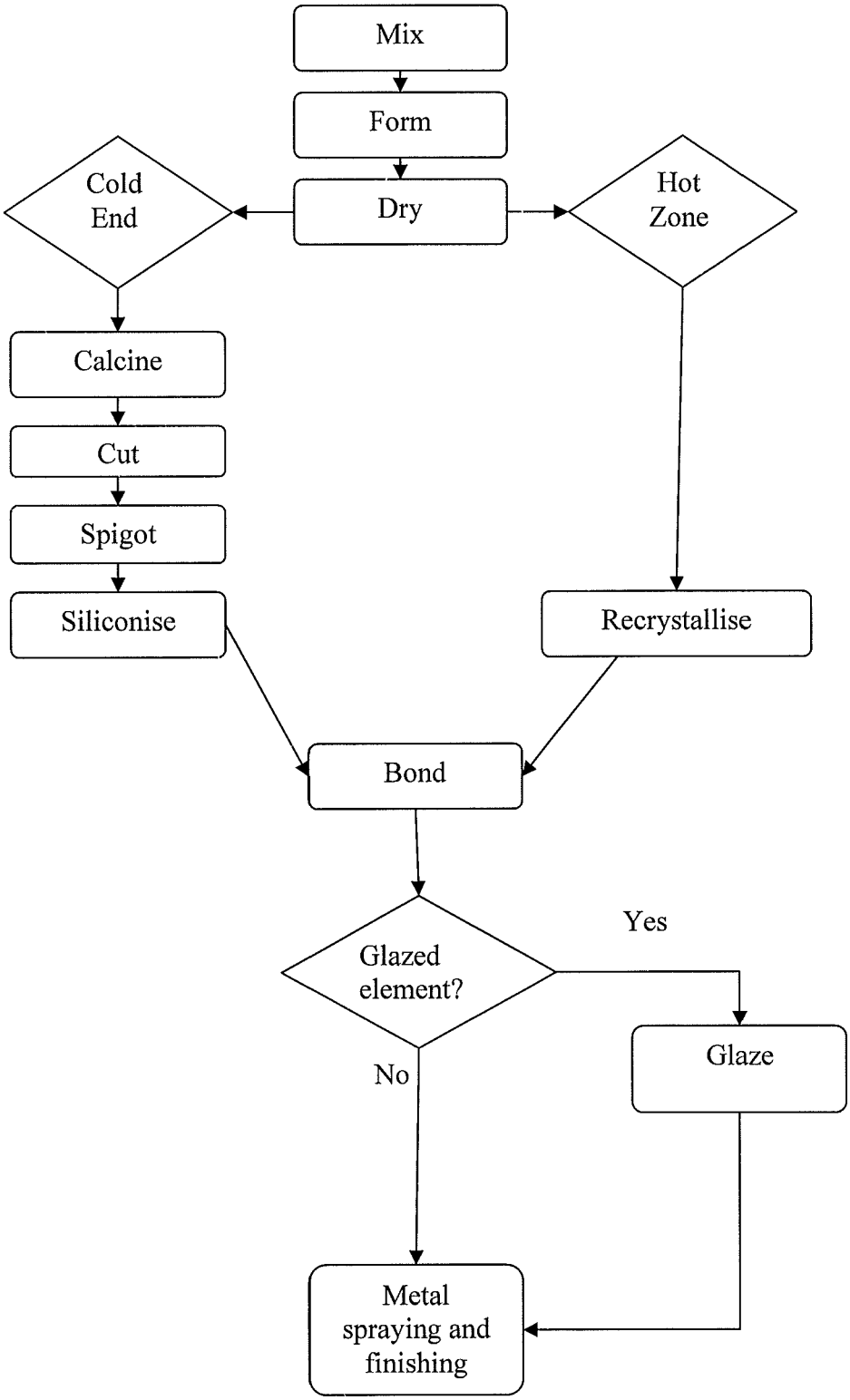
FIG. 1 is a flow chart showing the manufacturing process of a heating element.

FIG. 5*a* shows schematically a conventional rod form element 1 comprising a hot zone 2 and cold ends 3 meeting at hot zone/cold end interfaces 4 formed by the junction between the different materials of the hot zone and the cold ends.

A typical method of manufacture is to form the hot zone 2 and cold ends 3 separately and then join or weld them together to form the heating element. However, this does is not prevent other traditional methods known in the art being used including forming a one piece body such as helical cut tubes. In the present invention, no special treatment is necessarily applied to the hot zone since it is desired to maintain the hot zone at a relatively high resistance. However known processes such as forming a glaze to the element are not precluded. Any means known in the art to produce the hot zone using a silicon carbide base material is applicable. A suitable material is re-crystallised silicon carbide. The term 're-crystallised' indicates that after formation the material is heated to high temperatures (typically greater than 2400° C. e.g. 2500° C.) to form a self bonded structure comprising predominantly α-silicon carbide. Typical resistivity values of the hot zone range from 0.07 Ω·cm to 0.08 Ω·cm.

FIG. 1. shows an outline of a typical process used to manufacture a three piece welded heating element. For manufacturing the cold ends, predetermined amounts of silicon carbide powder of various particle size and purity and carbon and/or a carbon source (for example wood flour, rice hulls, wheat flour, walnut shell flour or any other appropriate source of carbon) are blended with a binder (for example a cellulose based binder) in a suitable mixer (for example a Hobart Mixer™) to the desired rheology for extrusion.

A typical formulation of the mix used for the cold end material is shown in Table 2.

TABLE 2

| Material | Commercial Name | Quantity (wt %) |
|---|---|---|
| Black Silicon Carbide | 36/70 Sika PCK | 15.79 |
| Green Silicon Carbide | F80 Sika III | 26.43 |
| Carbon source/porosity inducer | Wheat flour | 17.21 |
| Carbon source/porosity inducer | Wood flour | 6.71 |
| Carbon source | Petroleum coke powder | 31.46 |
| Binder | Magnafloc 139 | 2.37 |

Wheat flour and wood flour provide a carbon source and introduce porosity in the material. 36/70 Sika and F80 Sika are commercially available silicon carbide materials (supplied by Saint Gobain although other commercial equivalent grades can be used) and comprise predominantly α-silicon carbide. 36/70 Sika is black silicon carbide containing traces of minor impurities. F80 Sika is green silicon carbide and contains less impurities than black silicon carbide. Magnafloc® is a commercially available anionic acrylamide copolymer based binder material, manufactured by CIBA (WT), Bradford. The formulation is not restricted to this recipe and other recipes comprising silicon carbide, other sources of carbon and binders known in the art can be used. However, for the purposes of explaining the present approach the recipe shown in Table 2 was used throughout all of the investigations.

The mix is extruded into the desired shape although other forming techniques (e.g. pressing or rolling) may be used if appropriate. Conventional heating element shapes include rods or tubes. Once extruded, the shaped mix is allowed to dry to remove moisture and then calcined to carbonise the wheatflour and the wood flour carbon precursors so as to introduce porosity into the bulk material. Typically the porosity is above 40% resulting in a bulk density in the range 1.3 to 1.5 $g \cdot cm^{-3}$. The calcined material is then cut to the desired shape. For the jointed elements, a spigot manufactured from calcined cold end material may attached to one end by means of a cement comprising of a mixture of resin, silicon carbide and carbon. The spigot prepares the cold end material for attachment onto the hot zone material. (It is not necessary to use a spigot—welds can be made without a spigot—however a spigot reinforces the mechanical strength of the joint).

The final stage of preparation of the cold end is siliconising. This comprises the reaction of silicon with the carbon present and infiltration of molten silicon into the porosity of the calcined material. The calcined bar together with the attached spigot is placed in a boat and covered with a mixture of a controlled amount of silicon metal, vegetable oil and graphite powder, typically in the ratio 100:3:4. The amount of silicon required depends upon the porosity of the calcined bar—the lower the porosity the less silicon is required. Typical amounts are 1.4-2 (for example 1.6) times the weight of the calcined bar.

Typically a graphite boat is used for the siliconising step. The purity of the silicon metal is important so as to prevent any impurities interfering with the siliconising step. Various commercial silicon metals may be used depending upon grain size and purity. Typical impurities found in silicon metal are aluminium, calcium, and iron.

The boat containing the calcined bar and silicon/carbon mixture is then heated in a furnace under a protective atmosphere (for example flowing nitrogen) to a temperature in excess of 2150° C. A protective atmosphere limits undesirable oxidation of furnace components as well as the calcined material and silicon mixture at the high temperature. A nitrogen containing atmosphere is desirable as nitrogen acts a dopant of the silicon carbide formed. At this temperature, the silicon metal melts and infiltrates the pore structure of the calcined material whereby some reacts with the carbon in the body to form secondary silicon carbide and the remaining silicon fills the pore structure to provide an almost fully dense silicon-silicon carbide composite.

During the siliconising process, the silicon metal also permeates the joint between the spigot and the bulk material and reacts with excess carbon in the cement material to form a high temperature reaction bonded joint with the spigot.

The hot zone is made by analogous mixing, forming (e.g. by extrusion), and drying steps but not necessarily from the same mixture as the cold end [porosity for siliconising is not required for the hot zone] and is then recrystallised. For the purposes of this approach any hot zone material of appropriate resistance may be used and appropriate recrystallised α-silicon carbide bodies are available commercially.

The hot zone may then be attached to the cold end [i.e. to the other end of the spigot] using the same cement material completing the heating element. The heating element including the attached hot portion is then re-fired to temperatures sufficient to reaction bond the hot zone to the spigot. A typical temperature is between 1900° C. and 2000° C. which is below the temperatures at which β-SiC transforms to α-SiC. Optionally, a glaze or coating can be applied to the heating element to provide chemical protection to the under body.

As indicated above, other methods may be used for securing the hot zone to the cold ends without the use of a spigot.

If required a glaze may be applied to the element.

Conventionally, the surface of the cold end near the terminal end is then prepared to provide a smooth surface such as by sand blasting for a metallisation step. A metallisation coating provides an area of low electrical resistance so as to protect any attached electrical contacts from overheating. A metallisation layer such as aluminium metal is applied to the surface of a proportion of the cold end at the terminal ends by spraying or other means known in the art. Contact straps are then fitted over the metallised area to provide sufficient electrical connectivity to a power source. Further detail of the metallisation step is discussed below.

The present applicant has realised that by controlling the reaction parameters during the siliconising stage conditions can be created to promote β-silicon carbide formation rather than α-silicon carbide. The reaction rate is controlled by controlling process parameters such as silicon particle size, impurities and the reaction time during the siliconisation stage. By inhibiting the formation of α-silicon carbide at the siliconising temperature and increasing the proportion of β-silicon carbide in the bulk material of the cold end, the resistivity is reduced, resulting in an improved resistance ratio of the element. A number of process changes were used by the present applicant, each contributing to reducing the electrical resistance of the cold end bulk material. By combining these effects, the overall electrical resistance of the cold end may be substantially reduced. Below shows the process parameters investigated by the present applicant to reduce the electrical resistance of the cold end material.

Various commercial silicon metals having varying degrees of aluminium impurity were used in the manufacture of cold end materials. Table 3 shows the various commercial silicon metals used.

TABLE 3

| Supplier | Grain Size specified (mm) | Aluminium Content (%) |
|---|---|---|
| Elkem | 0.5-3 | 0.04 |
| Elkem | 0.2-2 | 0.17 |
| Graystar LLC | 0.5-6.0 | 0.21 |
| S & A Blackwell | 0.5-3.0 | 0.25 |

Variation in resistivity with aluminium content was found but it was evident that particle size of the silicon metal had a greater effect. The samples made using the Graystar LLC sourced material, having an aluminium content of 0.21% and a particle size in the range of 0.5-6.0 mm showed the least resistivity and so this aluminium content was used in all subsequent tests.

Figure 3:
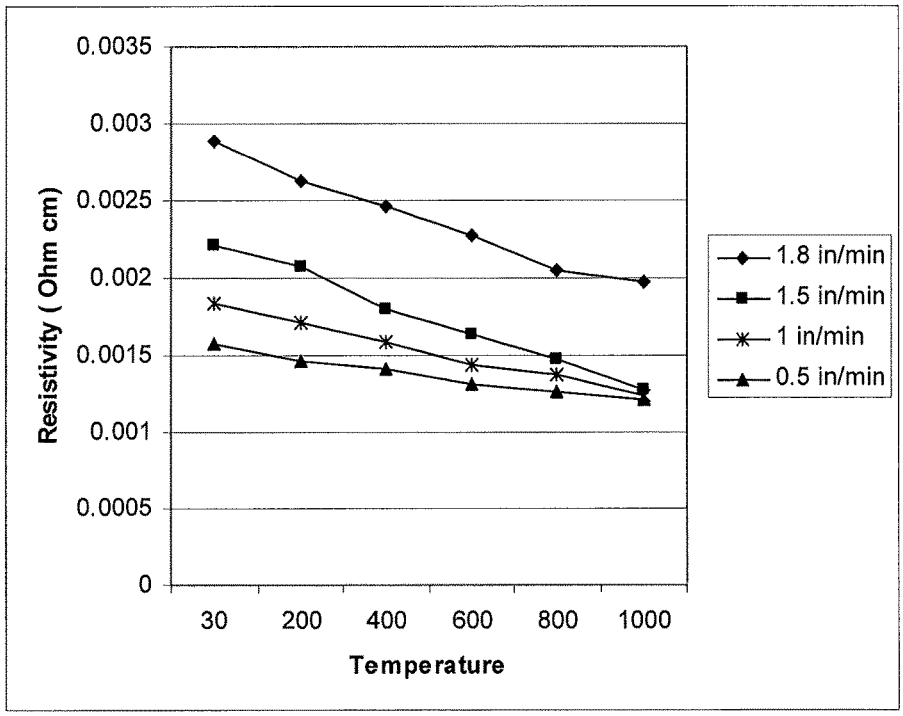
FIG. 3 is a plot of resistivity versus temperature for material produced from silicon of constant grain size and constant aluminium content formed by passing through a tube furnace at different speeds.

In order to isolate the effects of grain size on the resistivity of the cold end material from the other parameters, trials were performed using silicon metals during the siliconising procedure having a constant aluminium content of 0.21% (established in the earlier investigation) but varying grain size (see Table 4). FIG. 3 shows the variation of electrical resistivity with temperature for cold ends produced using silicon with varying grain sizes. All samples were processed in a graphite tube furnace at constant temperature of 2180 C and constant furnace push rate of ~2.54 cm/minute (1"/minute). The graph shows that there is a relationship between the particle size of the silicon with the resistivity of the cold end material. A particle size of less than 0.5 mm was considered detrimental to the process, although as discussed below lower particle sizes can be tolerated with suitable changes to manufacturing conditions.

TABLE 4

| Supplier | Grain Size Specified (mm) | Aluminium Content (%) |
|---|---|---|
| S & A Blackwell | 0.5-6.0 | 0.21 |
| S & A Blackwell | 0.25-6.0 | 0.21 |
| S & A Blackwell | 0.5-3.0 | 0.21 |
| S & A Blackwell | 0.2-2.0 | 0.21 |

Figure 2:
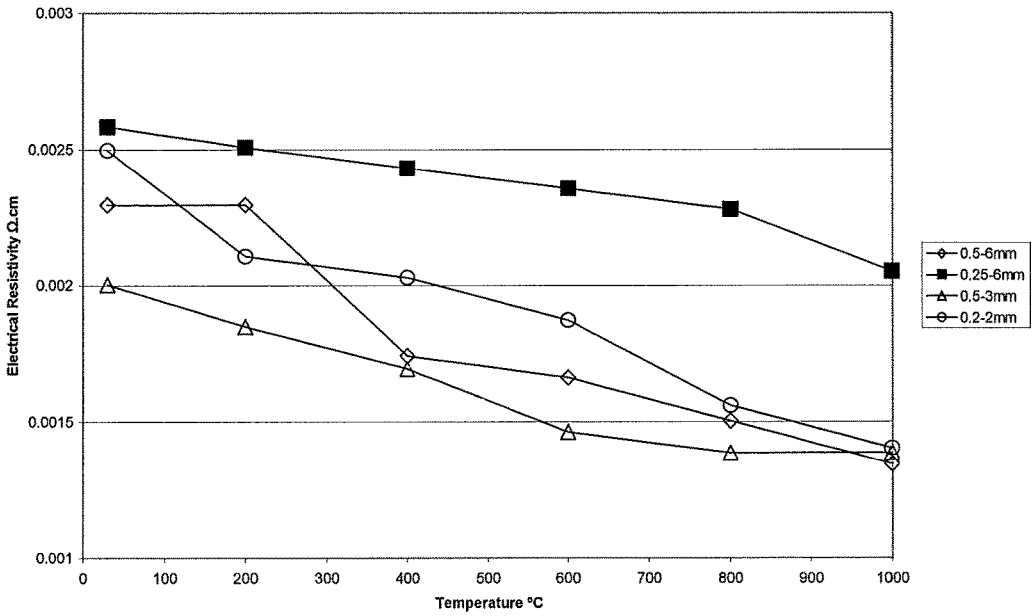
FIG. 2 is a plot of resistivity versus temperature for material produced from silicon of varying grain size and constant aluminium content.

Increasing the silicon particle size tends to reduce the rate of reaction of silicon and carbon such that the conditions for the formation of α-silicon carbide are not favourable. Consequently, β-silicon carbide is preferentially formed. Of course, too large a silicon particle size will result in poor coverage of the article being siliconised and may lead to inhomogeneity in the element produced. A minimum particle size of 0.5 mm is preferred, although as can be seen from FIG. 2, lower values can be tolerated.

Other controlling parameters affecting the reaction parameters and thereby affecting is the resistivity of the cold end, are the reaction temperature, the ramp rate to temperature, and the dwell time at the reaction temperature.

β-silicon carbide starts to convert to α-silicon carbide only at about 2100° C., and therefore, one would presume that by reducing the reaction temperature more β-silicon carbide would preferentially be formed. Siliconising the cold end material at temperatures ranging from 1900° C. to 2180° C. conducted in a tunnel furnace at a push rate of ~4.57 cm/minute (1.8 inch/min) and ~2.54 cm/minute (1 inch/min) revealed no clear relationship between the resistivity of the cold end material and the furnace temperature. In the majority of cases, the minimum resistivity value achieved was at a maximum furnace temperature of 2180° C., although for the reasons expressed below this need not be the maximum temperature experienced by the product. At relatively low temperatures such as 1900° C. siliconising was found to be incomplete and in areas the material remained unreacted.

In order to enable the reaction of silicon and carbon, a temperature in excess of 2150° C. appears to be advisable. This appears to be due to the fact that at atmospheric pressure, silicon oxide will not vapourise at lower temperatures and acts as a barrier to silicon movement. Any reaction between silicon oxide and carbon will also only occur at such temperatures. It has been shown that siliconising under a vacuum allows the reaction to occur at much lower temperatures, for example 1700° C. because vapourisation of silicon oxide occurs at lower temperatures in a vacuum. The applicant however believes that nitrogen is necessary as a dopant in order to optimise the resistivity of the cold ends rendering processing in a vacuum impractical. A partial pressure of nitrogen has been shown to decrease the resistivity of the product.

However, at temperatures above 2150° C. α-silicon carbide is formed.

Once the reaction is underway, the reaction between silicon metal and carbon is, exothermic. The exotherm results in a localised temperature increase within the carrier boats holding the carbonaceous silicon carbide and silicon. As α-silicon carbide is stable at higher temperatures than β-silicon carbide, the applicant believes that the localised temperature increase results in α-silicon carbide being formed in preference to β-silicon carbide. By controlling the effects of the exotherm, the transformation of β-silicon carbide to α-silicon carbide can be inhibited to some extent.

Figure 6A:
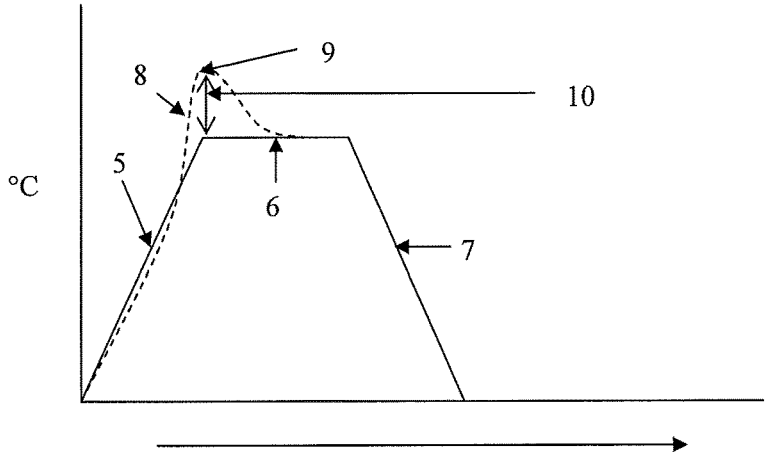

The effect of the exotherm can be controlled by the ramp rate to temperature, for example, in a tube furnace, by controlling the push rate through the furnace. FIG. 6*a* shows conceptually as a temperature/time diagram what is happening during a typical siliconisation step in a graphite tube furnace having a temperature profile with a uniform ramp rate to maximum temperature, a plateau at temperature, and a uniform cooling rate. As a carrier boat containing articles for siliconising passes through the furnace it experiences a furnace environment having the profile of the solid line represented by a ramp rate to temperature 5, a plateau temperature 6, and a cooling rate 7 down from temperature. The temperature of an article carried by the boat follows the temperature profile of the furnace until silicon begins to react with carbon.

The exothermic nature of this reaction means that the article will experience a localised temperature above that in the furnace environment. This is shown by the dotted line 8, indicating maximum temperature 9, with the temperature increase attributable to the exotherm being indicated as arrow 10.

Figure 6B:
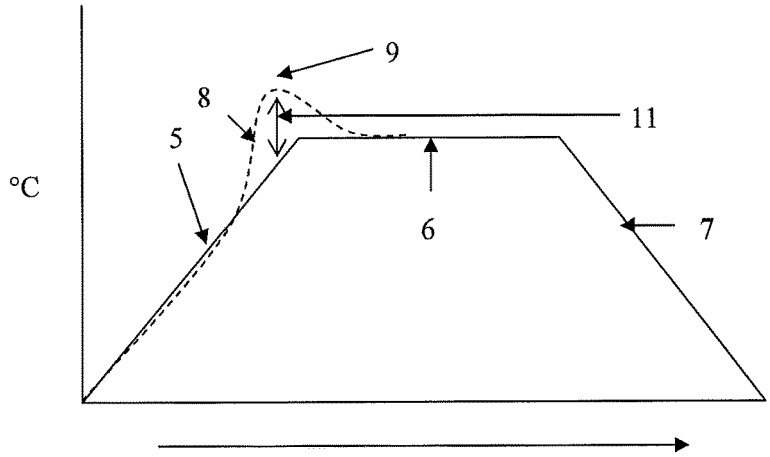

FIG. 6*b* shows the temperature for the same tube furnace but with a lower push rate of the carrier boat through the furnace. Although the rate of temperature increase of the article is slower during the initial heating cycle, this only becomes critical when the silicon oxide begins to vapourise. During this period, controlled evolution of silicon oxide vapour acts as a restriction on rapid infiltration of silicon into the article. This effectively controls the exothermic reaction of carbon and silicon, limiting the localised temperature increase. Additionally the slower rise to temperature gives a longer time for the heat generated by the exotherm to escape, so limiting the localised temperature increase. These limitations to the localised temperature increase result in a reduced conversion of β-silicon carbide to α-silicon carbide so resulting in a higher β-silicon carbide to α-silicon carbide ratio in the fired material.

Figure 6C:
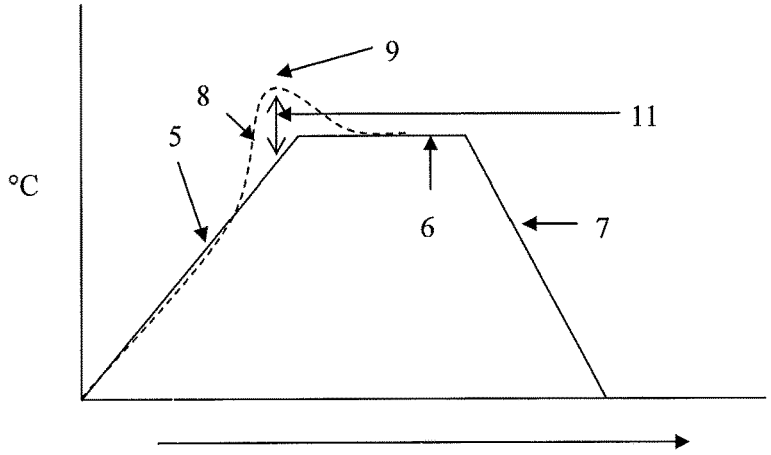

It will be noted that another result of slowing the push rate is that the ramp down from temperature takes longer and the time at the plateau is longer. This may facilitate more complete siliconising of the article and so increase the yield of β-silicon carbide. Of course too long at maximum temperature (if above 2100° C.) may start to result in transformation of β-silicon carbide to α-silicon carbide and so the actual time and temperature profile to use may vary. These times can be changed by using a tube furnace having a different temperature profile as indicated schematically in FIG. 6*c* in which a slow ramp up rate 5 as in FIG. 6*b* is combined with a faster ramp down rate 7 as in FIG. 6*a*.

In the above reference has been made to a tube furnace. It will be evident that similar temperature profiles may be obtained in other furnaces operating in batch or continuous mode with appropriate control of temperature and atmosphere. Further, more complex profiles can be adopted [e.g. a ramp rate to a first temperature, a dwell at that temperature to permit a large fraction of siliconising to occur, and then a change to a second temperature to permit the balance of siliconising to occur].

In order to investigate the effects of reaction time, a graphite tube furnace was used. The furnace used had internal dimensions ~20.3 cm (8") diameter×~152.4 cm (60") long. By varying the push rate through the furnace, the duration at the reaction temperature can be varied thereby controlling the reaction rate. The faster the push rate, the shorter the reaction time and conversely the slower the push rate the longer the reaction time. However, this does not prevent other furnaces known in the art being used that can provide varying reaction temperatures and reaction times.

Taking these factors into consideration, the present applicant investigated the resistivity of the cold end material siliconised at various push rates ranging from ~1.27 cm/min (0.5 in/min) to ~4.57 cm/min (1.8 in/min) at a fixed furnace temperature of 2180° C. In these investigations Graystar® silicon metal (as indicated in Table 3 above) was used, a minimum resistivity was obtained for a push rate of ~1.27 cm/min (0.5 in/min). FIG. 3 shows a plot of resistivity of the cold end material versus temperature when siliconised at different push rates. The reduction in resistivity achieved by slowing the push rate from ~2.54 cm/min (1 in/min) to ~1.27 cm/min (0.5 in/min) is small compared with that when the push rate is reduced from ~3.81 cm/min (1.5 in/min) to ~2.54 cm/min (1 in/min). Although the push rate of ~1.27 cm/min (0.5 in/min) showed the greatest reduction in resistivity, such a slow push rate may limit production capacity. A compromise can thus be made between the duration at the reaction temperature and production requirements. With the particular furnace used, a push rate of ~2.54 cm/minute (1 inch/minute) was considered optimum.

Example 1

This example aimed to make elements of similar geometry to the commercial element type Globar SD being 20 mm diameter, with a 250 mm hot zone length, and a 450 mm cold end length, and resistance 1.44 ohms A cold end mix was made according to the recipe shown in Table 2 (Mix A) and extruded into a tube. After calcining, the rod was cut into approximately 450 mm lengths and a spigot attached to the cold end material by applying a cement comprising silicon carbide, resin and carbon. The tube together with the spigot was then placed in a graphite boat for the siliconising stage and covered in a blanket of a predetermined amount of silicon metal and carbon. The cold end material was then siliconised using the process steps described above. These are:—

The particle size distribution of silicon was 0.5-6.0 mm;

The furnace push rate set to ~2.54 cm/min (1 inch/min);

The aluminium content of the silicon was 0.21%.

The cold end material was siliconised at a temperature of 2180° C. After the siliconising stage, a hot zone was attached onto the spigot of the cold end using the cement. A cold end was attached to either end of the hot zone. The hot zone was a 250 mm long recrystallised Globar SD Hot Zone material commercially available from Kanthal and identified as Mix B. The combination of the cold ends and the hot zone was then fired in a furnace to a temperature between 1900° C. and 2000° C., to reaction is bond the hot zone to the spigotted cold ends.

By using the optimised process parameters discussed above, resistivity of the cold end decreased from 0.03 Ω·cm for a conventional cold end to 0.012 Ω·cm at 600° C., which according to Ohm's Law represents a decrease in dissipated power of 66%. In terms of ratio of resistance of hot zone per unit length to cold end per unit length, the above techniques results in a ratio of 60:1 compared with 30:1 for commercial available standard material.

To measure the energy efficiency that results from the present approach, a formed heating element was installed into a simple brick lined furnace and the power required to maintain a furnace temperature of 1250° C. was measured and compared against a standard Globar element commercially available from Kanthal of exactly the same dimensions and resistance, the only difference being the cold end resistivity as described above.

The power consumed from the standard heating element was 1286 W but using the material according to the present approach a power of only 1160 W was consumed, which represents a power saving of 126 W or 9.8%.

Example 2

As a further illustration of the advantages of the present approach, comparisons were made between samples prepared using the technique described in Example 1 with known samples currently on the market. Samples were randomly taken from each of the cold ends and hot zone from a number of heating elements. Samples 1 to 2 represent material that have undergone different process treatments and Samples 3 and 4 represent commercial materials. A description of each sample type is shown in Table 5.

TABLE 5

| Sample Type | Description |
|---|---|
| Sample 1 | Material according to the present approach (Graystar silicon 0.25-6.0 mm; 0.20% Al; furnace push rate 1 inch/min) - see Example 1 |
| Sample 2 (Comparative) | Sample 1 but furnace push rate set to 1.8 inch/min |
| Sample 3 (Comparative) | Commercial material (Erema E ®) |
| Sample 4 (Comparative) | Commercial material (I2R Type ®) |

Due to the difficulty in accurately differentiating between α-silicon carbide and 3-silicon carbide using x-ray diffraction techniques, samples were analysed using Electron Back Scattered Diffraction (EBSD). As is known in the art, EBSD uses back scattered electrons emitted from the sample in a SEM to form a diffraction pattern that is imaged on a phosphor screen. Analysis of the diffraction pattern allows the identification of the phases present and their crystal orientation. Backscattered and fore-scatter detector (FSD) image were gathered using the diodes on a NordlysS detector. Secondary and in-lens images were gathered using the detectors on the SEM. The EBSD patterns were gathered and saved using the OI-HKL NordlysS detector. The EBSD and Energy Dispersive Analysis Spectrum (EDS) maps were gathered using OI-HKL CHANNELS software (INCA-Synergy). By setting the EBSD to analyse the diffraction pattern generated by the phases:

α-silicon carbide (SiC 6H);

β-silicon carbide (SiC 3C);

silicon;

and carbon their quantitative amounts can thus be determined. The crystal structures of the phases used in the analysis is shown in Table 6.

TABLE 6

| Phase | Crystal Structure | Lattice parameter (Å) |
|---|---|---|
| SiC 3C (β) | Cubic | a = 4.36 |
| SiC 6H (α) | Hexagonal | a = 3.08, c = 15.12 |

TABLE 6-continued

| Phase | Crystal Structure | Lattice parameter (Å) |
|---|---|---|
| Si | Cubic | a = 5.43 |
| C | Amorphous | — |

Figure 4A:
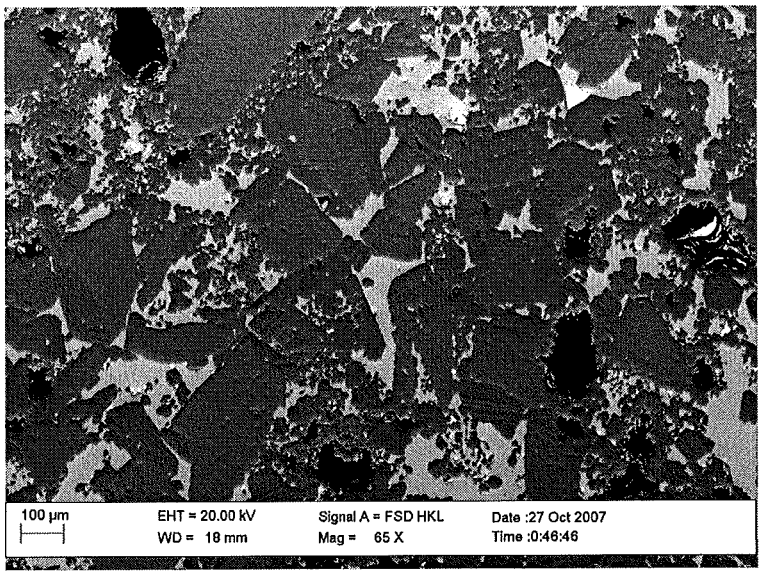
FIGS. 4(*a-b*) are a back scattered and scanning electron micrograph respectively of a sample processed according to one approach of the present disclosure.
Figure 4B:
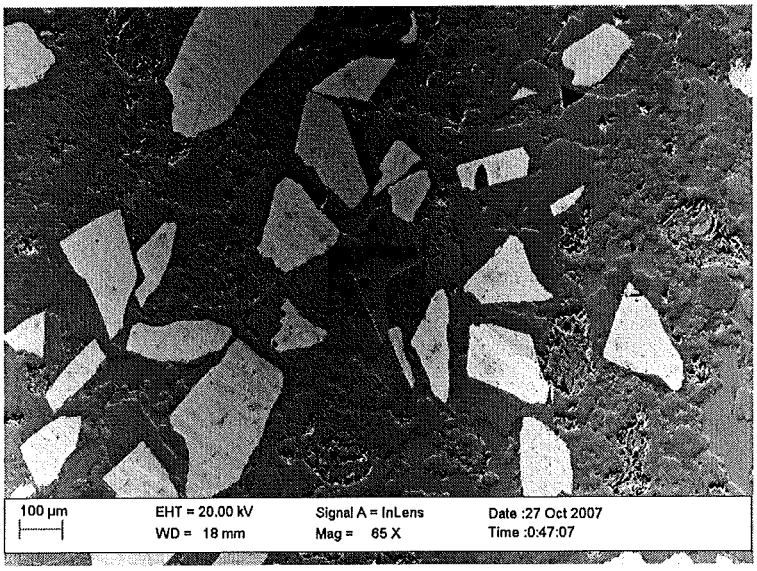

FIG. 4*a* shows a backscattered image for Sample 1. The different contrasts in the image represent the different phases in the body of the material. The dark areas represent graphite, the grey areas represent silicon carbide and the light areas represent silicon. The phase contrast between α-silicon carbide phase (SiC 6H) and 13-silicon carbide phase (SiC 3C) can be made out in the SEM in-lens detector image shown in FIG. 4*b*. The grey areas represent the β-silicon carbide phase (SiC 3C) and the lighter areas represent the α-silicon carbide phase (SiC 6H). The remainder of the body is a matrix of carbon and silicon. Image analysis was used to measure the proportion of α-silicon carbide phase (SiC 6H) and β-silicon carbide phase (SiC 3C) in the image.

Table 7 shows a breakdown of the results for Samples 1 to 4 measured using the above technique and comparisons were made with their corresponding electrical properties.

TABLE 7

| Properties | Sample 1 | Sample 2 | Sample 3 | Sample 4 |
|---|---|---|---|---|
| SiC 3C (β) Vol % | 51 | 37 | 36 | 31 |
| SiC 6H (α) Vol % | 28 | 30 | 36 | 14 |
| Silicon Vol % | 15 | 15 | 15 | 7 |
| Carbon Vol % | 6 | 18 | 13 | 48 |
| Mean Resistivity of Cold End Ω · cm | 0.001269 | 0.002473 | 0.003600 | 0.002368 |
| Mean Resistance per unit length of Cold End (RCE) Ω/cm | 0.000550 | 0.001071 | 0.001522 | 0.001099 |
| Mean Resistivity of Hot Zone Ω · cm | 0.070184 | 0.073076 | 0.075119 | 0.071737 |
| Mean Resistance per unit length of Hot Zone (RHE) Ω/cm | 0.030394 | 0.031646 | 0.031765 | 0.033296 |
| Mean Ratio of RHE:RCE (equivalent to ratio of resistivity as uniform cross section) | 55.300 | 29.5474 | 20.8636 | 30.29327 |

Sample 1 represents the optimum material formulated according to an embodiment of the present approach and demonstrates a positive relationship between the proportion of β-silicon carbide (51 vol %) in the body with its corresponding electrical properties.

Moreover, Sample 1 yields the greatest proportion of total SiC (51 vol %+28 vol %). By optimally controlling the process parameters, more SiC is generated through reaction alone.

Comparing Sample 1 with Samples 2 and 3 it can be seen that the increased proportion of β-silicon carbide in Sample 1 (51% compared with 37% and 36% in Samples 2 and 3) results in a lower resistivity material. The effect of the reduced resistivity has a direct effect in improving the ratio of the resistance per unit length of the hot zone to cold end.

Thus, by optimising the control parameters during the reaction between silicon and carbon, conditions that promote the formation of the more electrically conductive β-silicon carbide (SiC 3C) component can be created.

Traditionally only a small area of the cold end body at the terminal ends is metallised in order to create an area of lowered contact resistance onto which metallic contact straps such as aluminium braid are fitted with spring clips or clamps. This is to prevent the electrical contacts from overheating and thus, degrading. This has been the norm for many years. For example, Table 8 below indicates the diameter, cold end length and metallised length for some commercial elements from two manufacturers. Also shown are the % of cold end sprayed and the ratio of the metallised length to diameter. Typically, aluminium metal is used for the metallisation process

TABLE 8

| Diameter (mm) | Min cold end length (mm) | Metallised length (mm) | % cold end sprayed | Metallised length/diameter |
|---|---|---|---|---|
| | | Kanthal | | |
| 10 | 100 | 50 | 50.0% | 5.00 |
| 12 | 100 | 50 | 50.0% | 4.17 |
| 14 | 100 | 50 | 50.0% | 3.57 |
| 16 | 100 | 50 | 50.0% | 3.13 |
| 20 | 100 | 50 | 50.0% | 2.50 |
| 25 | 200 | 50 | 25.0% | 2.00 |
| 32 | 250 | 70 | 28.0% | 2.19 |
| 38 | 250 | 70 | 28.0% | 1.84 |
| 45 | 250 | 70 | 28.0% | 1.56 |
| 55 | 250 | 70 | 28.0% | 1.27 |
| | | Erema | | |
| 10 | 150 | 30 | 20.0% | 3.00 |
| 12 | 150 | 30 | 20.0% | 2.50 |
| 14 | 200 | 30 | 15.0% | 2.14 |
| 16 | 250 | 30 | 12.0% | 1.88 |
| 20 | 300 | 50 | 16.7% | 2.50 |
| 25 | 300 | 50 | 16.7% | 2.00 |
| 30 | 300 | 50 | 16.7% | 1.67 |
| 35 | 300 | 50 | 16.7% | 1.43 |
| 40 | 300 | 50 | 16.7% | 1.25 |
| 45 | 400 | 50 | 12.5% | 1.11 |
| 50 | 400 | 50 | 12.5% | 1.00 |

Figure 5:
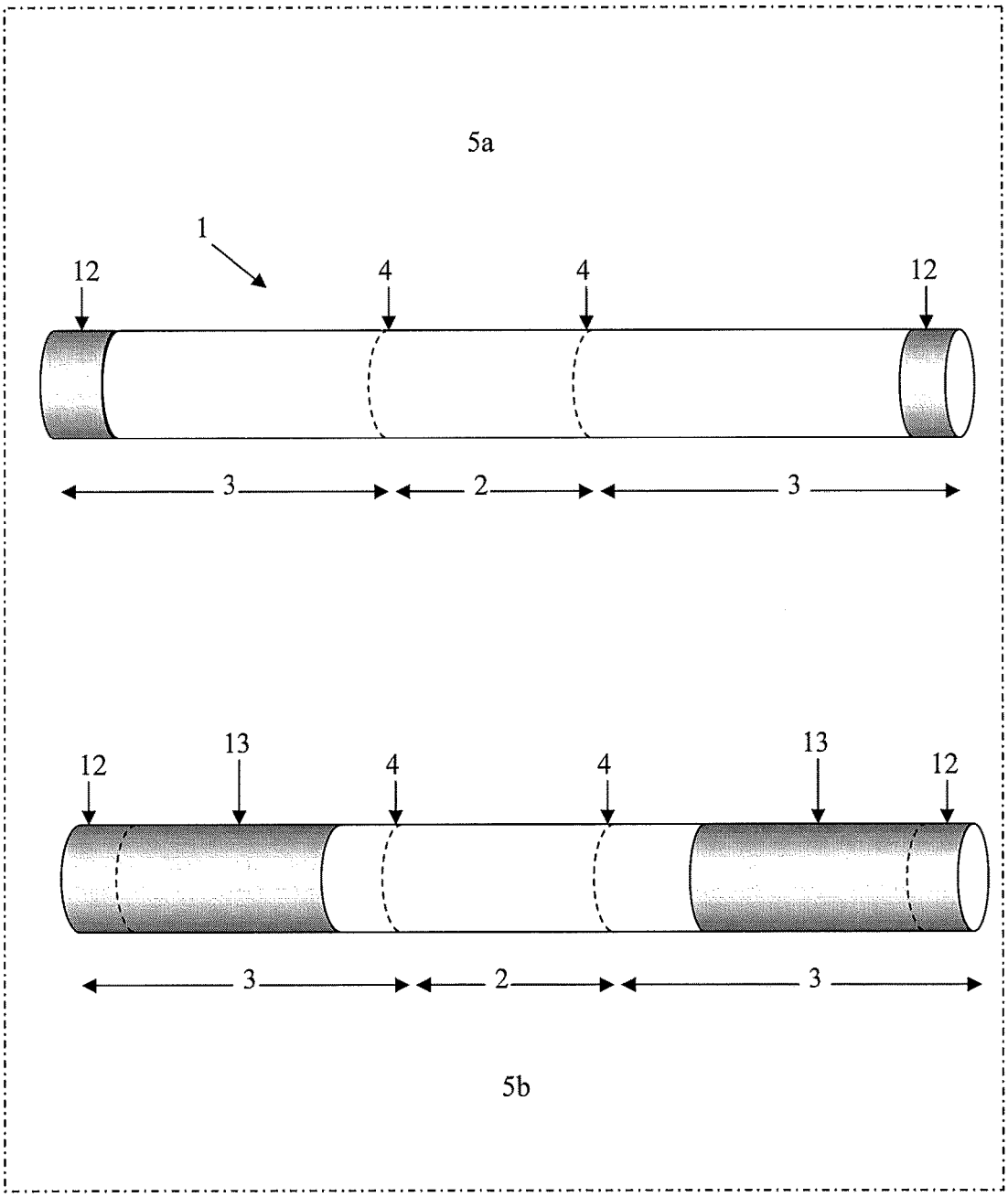
FIGS. 5(*a-b*) are schematic diagrams of heating elements depicting the degree of coating on the cold end material FIGS. 6 (*a-c*) are conceptual schematics describing the firing process during formation of a cold end material.

The present applicant has realised that by applying an electrically conductive coating along an increased proportion of the length, a reduced resistance path is provided to the hot zone, thereby increasing the electrical resistance ratio of the hot zone to the cold end. This is demonstrated by a schematic representation of the heating element as shown in FIG. 5(*a* and *b*). FIG. 5*a* shows the case using traditional metallisation techniques in which terminal portions 12 are provided to permit contact with conductors. The cold ends between terminal portions 12 and the cold end/hot zone interfaces 4 are not metallised. Over this non-metallised portion current transfer is entirely through the material of the cold end.

By applying a conductive coating over 70% or more of the length of the cold end [>70%, or >80% or >90%, or even the entire cold end] an additional path for current is provided in parallel with the cold end material. This conductive coating may be a metallisation. FIG. 5*b* shows an element in accordance with this aspect in which a conductive coating (12, 13) extends over a large part of the surface of the cold end providing both a parallel and preferred conductive path 13, and, at the ends remote from the hot zone, terminal portions 12.

Although aluminium has traditionally been used, and could be used in the present invention, in some cases it is not best suited as a coating material because the high temperatures experienced near the hot zone may tend to degrade the aluminium coating. Metals more resistant to degradation at high temperatures may be used. Typically such metals would have melting points above 1200° C., or even above 1400° C. Example of such metals include iron, chromium, nickel or a combination thereof, but the invention is not limited to these metals. In the most demanding applications more refractory metals could be used if desired. Although metals have been mentioned above any mechanically and thermally acceptable material that has a significantly lower electrical resistivity than the material of the cold end would achieve a benefit over an untreated cold end.

Moreover, more than one type of coating can be applied to the cold end to cater for the different temperatures experienced along the cold end. For example, aluminium metal could be used near the terminal end or electrical contact area where it is relatively cold and a higher melting point metal, or one less reactive, could be used at the higher temperature region near the hot zone.

Since the metallisation process provides an area of lowered resistance, it has the advantage that it can improve existing high resistive materials and that is the subject of the presently claimed invention. For example, the metallisation coating can be used to convert a high resistive recrystallised body which would generally be used for the hot zone, to a cold end and yet be able to provide a respectable electrical resistance ratio, for example in the order of 30:1.

Figure 8:
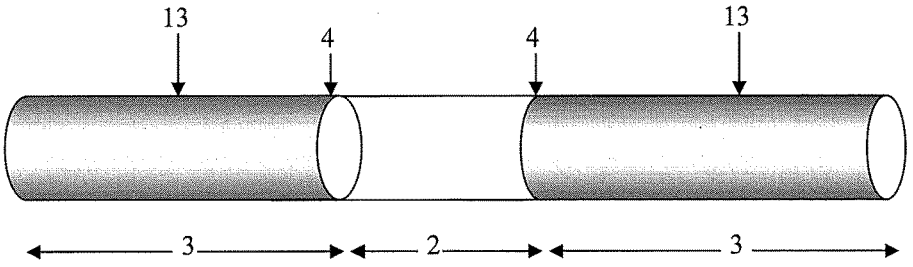
FIG. 8 is a schematic diagram of a heating element as claimed.

In some cases, this does away with the need to formulate a separate cold end body and would also enable elements of one piece construction to be utilised. In some applications one piece elements have advantages in terms of mechanical strength. FIG. 8 shows an element formed of a single piece of recrystallised silicon carbide in which the extent of metallisation 13 defines the cold ends 3.

Figure 7:
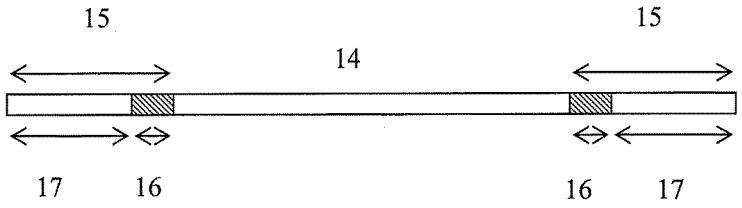
FIGS. 7(*a-b*) are schematic diagrams of heating elements with different structured cold ends.
Figure 7:
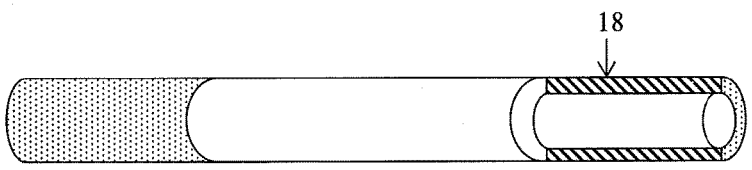

Furthermore, cold ends of multiple sections can be manufactured. Such cold ends would have the advantage that the thermal conductivity of the recrystallised material is believed to be below the thermal conductivity of the normal cold end material and so acts to reduce heat loss through the cold end. Such an element is shown in FIG. 7*a*) described below.

In other instances, the conductive coating would equally be applicable to heating elements formed as one piece such as helical tubular rods. Typical rods of this type are Crusilite™ Type X elements and Globar™ SG and SR rods. When applied to the cold end formed by the first approach described above, the effect of the metallisation coating increases the electrical resistance per unit length ratio to values exceeding 100:1.

Traditionally, the coating is applied by flame spraying aluminium wire. so that the aluminium adheres to the surface of the body. The present applicant has realised that the coating process is not restricted to such techniques and other coating techniques can be used, and for some metals will necessarily be used. Examples of such methods include plasma spraying and arc spraying. Arc spraying can be used for some high temperature resistant metals, for example Kanthal® spray wire—a range of FeCrAl FeCrAlY and Ni—Al alloys—and these materials can conveniently be used in the present invention.

Example 3

To verify the effects of a metal coating independent of the underlying body, the metallisation technique of the present invention was applied to two types of cold end body materials.

The first element (FIG. 5*b*) was as described in Example 1.

The second element (FIG. 7*a*) was of like dimensions to the first element, but comprised a hot zone 14 with hybrid cold ends 15 comprising one part 16 formed from the mixture of Table 2 siliconised according to the process parameters described in Example 1, and a second part 17 formed from recrystallised hot zone material (Mix B).

In both cases the length of the cold end was kept to 450 mm. For the hybrid material, 100 mm of its length is formed from Mix A and the remaining part of the cold end is extended to 450 mm by attaching 350 mm of recrystallised hot zone material (Mix B).

The hot zone body made from Mix B consisting of recrystallised Globar SD (see Table 2) was then attached to the cold end body material to complete the heating element. The cold end (450 mm) was then metallised by spraying with aluminium metal. In the particular investigation the entire length of the cold end was metallised but it will be evident that this is not a necessary requirement.

The heating element was then installed into a simple brick-lined furnace and the power required for maintaining the furnace temperature at 1250° C. was measured. Comparisons were made with a standard "GLOBAR SD" heating element of like hot zone and cold end dimensions to the first and second element, but metallised as known in the art, i.e. where only 50 mm of the cold end is metallised (see FIG. 5*a*).

It was found that the power consumed from the standard heating element (FIG. 5*a*) was 1286 W but using the improved metallisation step according to the present invention, a power consumption of only 1160 W was consumed when the cold end body was made entirely of Mix A (FIG. 5*b*), which represents a power saving of 126 W or 9.8%. Moreover, using the improved metallisation process on the hybrid cold end material consisting partially of recrystallised hot zone material (FIG. 7*a*), a power of 1203 W was consumed, representing a power saving of 83 W or 6.4%.

Although the underlying hybrid cold end body of FIG. 7*a* is not as efficient as the cold end described in Example 1 [FIG. 5*b*], the lower power consumption in comparison to standard heating elements known in the art demonstrates the benefits of overspraying the cold end body thereby creating an area of reduced resistance.

Example 4

In a further test, comparisons were made to see the effects of metallising an underlying cold end body using the improved metallisation step according to the present invention. In these tests 200 mm (80% of the cold end length) from the terminal end was metallised compared to 50 mm (20% of the cold end length) as in known art. In both cases, the metallising coating was applied to a cold end formed using the process parameters as described in Example 1.

The heating element was made to the following size:—

Hot Zone:—950 mm (recrystallised Globar SD™)

Cold End:—250 mm

The power required to maintain the heating elements at a hot zone surface temperature of 1000° C. in free air was measured. Using the conventional terminal metallisation technique, the ratio of the electrical resistance per unit length of the hot zone to the cold end was measured to be 54:1. However, using the metallisation coating of the present invention, the ratio improved to 103:1, which by calculation from Ohm's Law represents a substantial reduction in power dissipation of 50%.

The reduced resistivity of the new cold end materials of the present invention is accompanied to some extent by an increase in thermal conductivity which can offset to a degree some of the advantages of the material. However, this can be put to advantage in that the cross-section of the cold end can be reduced while still retaining an acceptably good ratio of hot zone to cold end electrical resistivity (e.g. 30:1). Such a construction reduces heat transfer within the cold end in comparison with a full diameter cold end of the same material. This reduction in cross section can be achieved for tube elements by increasing the inner diameter of the cold end tube while leaving the outer diameter constant to match the outer diameter of the hot zone. However, it is preferable to instead reduce the outer diameter of the cold ends so that they are narrower than the hot zone. This has particular advantage in that:—

- the radiating surface of the cold end is reduced, so reducing heat loss
- the cold ends can be covered with thermally insulating material or a thermally insulating sleeve to reduce heat loss still further
- the insulating material or insulating sleeve need not extend beyond the outer diameter of the hot zone.

Heat transfer through the cold ends can also be reduced by thinning or perforating the material at selected points in the cold ends (e.g. by use of slots), and this can be combined with reducing the thickness of the material over all or part of the cold ends Providing thermally insulated cold ends will result in reduced heat loss and so a raised temperature of the cold end. This elevation in temperature will result in a lowering of resistivity and hence of cold end resistance.

The cold end does not to be reduced in cross-section over its entire length.

Example 5

Elements as specified in Table 9 below were tested in a specially-built Element Test Furnace, constructed by Carbolite, furnace design number 3-03-414 in such a way that all external ambient conditions had no effect on the power required to hold the furnace at temperature. Using this furnace, it was possible to control and monitor all aspects of the conditions in which the elements were tested including:—

- furnace temperature;
- desired surface power load applied to the elements (by use of water-cooled tubes acting as an artificial load extracting heat from the furnace); and,
- the atmospheric conditions.

The elements were tested in sets of three at a time, the power to each element being separately controlled depending on the resistance of each element. Each test was conducted under a constant flow of dry nitrogen gas regulated into the furnace at 20 liters/min. This gave constant atmospheric conditions. The furnace insulation, element lead-in holes, aluminium straps and element power clip connections remained constant throughout testing of the various element types. The power applied to each element was monitored at 10 minute intervals and in this way a determination of the point at which equilibrium or steady state conditions applied (power supplied matching heat loss to the load and environment) could be made.

TABLE 9

| Element Type | Resistance ratio RHE:RCE | Cold End Cross section ($cm^2$) | Mean Power (W) | Saving (%) |
|---|---|---|---|---|
| 3 piece element as FIG. 5a, conventional material cold ends - Cold end material as Sample 2, Table 5<br>Cold end 19.1 mm outer diameter (OD) × 8.5 mm inner diameter (ID) | 25.0 | 2.3 | 8537.36 | |
| 3 piece element as FIG. 5a, low resistivity cold ends<br>Cold end material as Sample 1, Table 5<br>Cold end 19.1 mm OD × 8.5 mm ID | 65.2 | 2.3 | 8369.68 | 1.97 |
| 3 piece element with insulated 14 mm cold ends as FIG. 7b<br>Cold end material as Sample 2, Table 5<br>Cold End 14.0 mm × 7.5 mm ID<br>Hot zone 19.1 mm OD | 27.2 | 1.1 | 8331.45 | 2.41 |
| 3 piece Globar SD with 14 mm insulated and plugged cold ends as FIG. 7b, with bore insulated<br>Cold end material as Sample 2, Table 5<br>Cold End 14.0 mm × 7.5 mm ID<br>Hot zone 19.1 mm OD | 27.2 | 1.1 | 8318.78 | 2.56 |

Under these test conditions results as detailed in Table 9 were obtained for elements [of Globar SD 20-600-1300-2.30 design within modifications indicated in Table 9], where the diameter is nominally 20 mm and the hot zone length is 600 mm and the overall length is 1300 mm and the nominal resistance is 2.30 ohms. The furnace temperature was set at 1000° C. and the water cooling system arranged in such a way that a surface power loading on the elements of approximately 8.5 Watts/$cm^2$ was achieved. These conditions are representative of one set of typical conditions under which such elements can be used.

As can be seen, the change from standard cold end material with geometry as defined in FIG. 5*a* to new cold end material yields a 1.97% reduction in power use at equilibrium.

In reducing the cross sectional area of the cold end and applying a 2.5 mm thick layer of ceramic fibre insulation material 18 as shown in FIG. 7*b*, in this case to 47.8% of the original, the element ratio decreases from 65:1 to 27:1 but the power saving is seen to improve from 1.97% to 2.41%. This clearly demonstrates that despite a decreased hot zone: cold end resistance ratio, the efficiency of the heating element is improved as a result of the reduction of the cross section. Insulating the cold ends has the combined effect of preventing heat loss and increasing the material temperature, thereby further reducing the resistivity. Also the nominal diameter of the element remains unchanged and the element continues to be easily located into a lead-in hole in a furnace with no additional insulation or plugging required.

Furthermore, if the cold ends are insulated with a 2.5 mm thick ceramic fibre insulating material, a further power reduction is realised from 1.97% to 2.56% over standard. Insulating the bore of the cold ends has an additional effect of preventing heat loss and increasing the cold end material temperature, thereby further reducing the resistivity

Example 6

To provide a comparable set of performance results a number of elements tubular elements were made which [except where indicated] had nominal 20 mm diameter cold ends each of 375 mm length bracketing a 20 mm diameter hot zone of 600 mm length. Actual diameters were:—

| Nominal diameter (mm) | Minimum outer diameter (mm) | Maximum outer diameter (mm) | Minimum inner diameter (mm) | Maximum inner diameter (mm) |
|---|---|---|---|---|
| 20 | 18.80 | 19.30 | 7.90 | 8.70 |

These elements were tested in the manner of Example 5 above and the 12 hour equilibrium powers required to maintain a temperature of 1000° C. are summarised in Table 10.

| | Power [W] | % Power | % Saving | Resistance ratio |
|---|---|---|---|---|
| [A] A one piece recrystallised silicon carbide element in which end portions were impregnated with silicon to form the cold ends | 8410 | 100 | 0 | 13.1 |

-continued

| | Power [W] | % Power | % Saving | Resistance ratio |
|---|---|---|---|---|
| [B] A one piece recrystallised silicon carbide element in which end portions were impregnated with silicon to form the cold ends and the bore of the tube plugged with refractory fibre | 8416 | 100.07 | −0.07 | 13.2 |
| [C] A three piece recrystallised silicon carbide hot zone having silicon impregnated silicon carbide cold ends bonded to the hot zone | 8424 | 100.17 | −0.17 | 24.7 |
| [D] A three piece recrystallised silicon carbide hot zone having cold ends formed by the first approach mentioned above bonded to the hot zone | 8357 | 99.38 | 0.62 | 52.1 |
| [E] A three piece recrystallised silicon carbide hot zone having 14 mm diameter terminals cold ends formed by the first approach mentioned above bonded to the hot zone | 8375 | 99.59 | 0.41 | 25.3 |
| [F] A single piece recrystallised silicon carbide element sprayed with metal [FeCrAl] to form cold ends | 8139 | 96.78 | 3.22 | 16.9 |
| [G] A single piece recrystallised silicon carbide element sprayed with metal [FeCrAl] to form cold ends with the bore of the tube plugged with refractory fibre | 8128 | 96.65 | 3.35 | 16.9 |
| [H] A five piece element comprising a recrystallised silicon carbide hot zone, 75 mm silicon impregnated cold end portions attached to the hot zone, and metallised recrystallised silicon carbide terminal portions completing the cold zones [FIG. 7a) | 8049 | 95.71 | 4.29 | 51 |

As can be seen, in these tests, metallisation of a recrystallised silicon carbide material to form a cold end provided significant power savings over using conventional silicon impregnated cold ends. A hybrid element in which a material of lower electrical resistance than the recrystallised silicon carbide [e.g. silicon impregnated silicon carbide] is interposed between the recrystallised silicon carbide and the hot zone provided still better savings.

Figure 9:
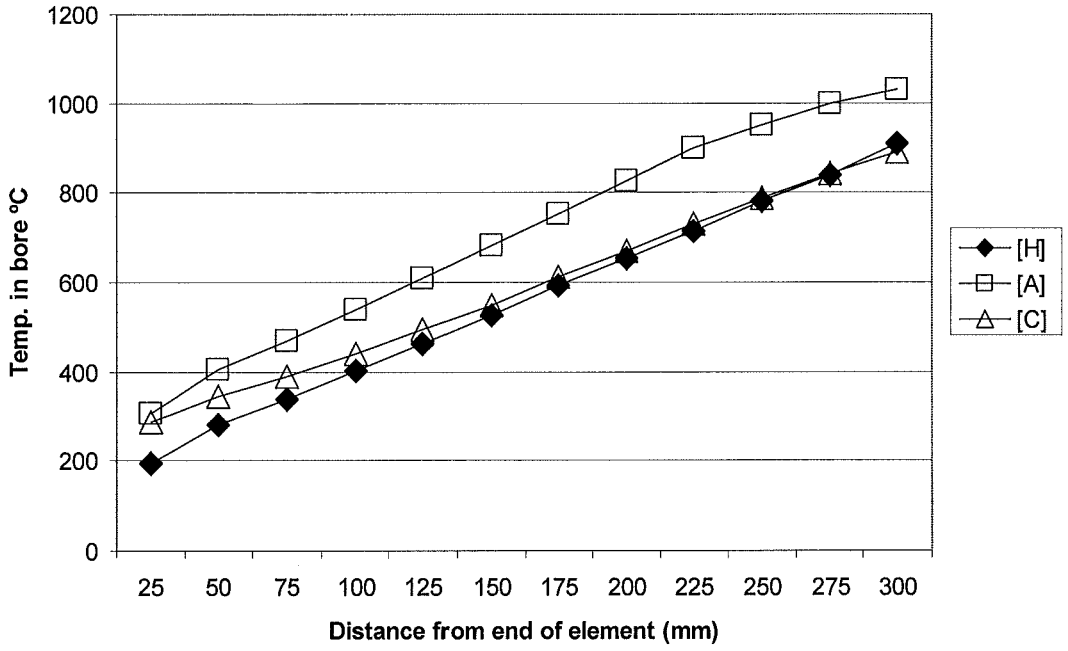
FIG. 9 shows temperatures internal to some heating elements.

A further effect of using metallised recrystallised silicon carbide as a means of reducing heat loss from the ends of silicon carbide heating elements, is that it results in lower temperatures at the terminal end of the element. FIG. 9 shows the results of measurement of temperature in the bore of elements [A], [C], and [H] above. As can be seen the temperature at the terminal end [~25 mm from the end] is significantly lower for element [H] in accordance with the present invention than for elements [A] and [C]. Lower terminal end temperatures will reduce the risk of overheating of the is terminal straps.

The relative lengths of relatively low electrical resistance cold end material and metallised recrystallised silicon carbide can be chosen to meet the particular application. The length of the section relatively low electrical resistance cold end material can be varied, according to the total length of the cold end, the operating temperature of the furnace, and the thickness and insulation properties of the thermal lining of the equipment. Preferably the relatively low electrical resistance cold end material will be less than 50% of the total length of the cold end that is positioned inside the thermal lining.

For example, if the thermal lining is 300 mm thick, and the total cold end length is 400 mm, there will be 100 mm length of cold end positioned outside the confines of the lining, to allow electrical connections to be made, and 300 mm of cold end within the confines of the thermal lining. In this case, the preferred length of the relatively low electrical resistance cold end material interposed between the metallised recrystallised silicon carbide and the hot zone will be less than 50% of 300 mm, or less than 150 mm. It will be apparent that more than just five sections [as in example [H]] can be used in constructing a silicon carbide heating element, and such constructions are included in the scope of the present invention.

In the above, discussion has been primarily about tubular elements. It should be understood that the present invention encompasses rod elements and elements of cross section other than circular. Where the word "diameter" is used this should be taken as meaning the maximum diameter transverse to the longest axis of the element, or part of element, referred to.

The presently claimed invention only claims some of the inventive features disclosed. To preserve the right to file divisional application the applicant indicates that one or more of the following features alone or in combination may be the subject of later divisional applications.

i) A silicon carbide heating element having one or more hot zones and two or more cold ends, the hot zones comprising a different silicon carbide containing material from the cold ends, and in which the silicon carbide in the material of the cold ends comprises sufficient β-silicon carbide that the material has an electrical resistivity less than 0.002 Ω·cm at 600° C. and less than 0.0015 Ω·cm at 1000° C.; optionally in which:— the material of the cold ends comprises α-silicon carbide and β-silicon carbide; optionally in which the volume fraction of β-silicon carbide is greater than the volume fraction of α-silicon carbide; and/or the ratio of the volume fraction of β-silicon carbide to the volume fraction of α-silicon carbide is greater than 3:2; and/or the material of the cold ends comprises greater than 45 vol % β-silicon carbide; and/or the total amount of silicon carbide is greater than 70 vol %; and/or the material of the cold end comprises:—

| | | |
|---|---|---|
| i. | SiC | 70-95 vol % |
| ii. | Si | 5-25 vol % |
| iii. | C | 0-10 vol % |

with SiC+Si+C making up >95% of the material of the material; and/or;

the ratio of the electrical resistivity of the material of the hot zone to the electrical resistivity of the material of the cold end is greater than 40:1.

ii) A method of manufacture of a cold end for a heating element, the method comprising the step of exposing a carbonaceous silicon carbide body comprising silicon carbide and carbon and/or carbon precursors, to silicon at a controlled reaction temperature sufficient to enable the silicon to react with the carbon and/or carbon produced from the carbon precursors to form β-silicon carbide in preference to α-silicon carbide, and for an exposure time sufficient that the amount of β-silicon carbide in the cold end is sufficient that the material has an electrical resistivity less than 0.002 Ω·cm at 600° C. and less than 0.0015 Ω·cm at 1000° C.; optionally in which:— the reaction parameters are controlled to promote β-silicon carbide formation in preference to α-silicon carbide by controlling one or more of the following process variables:— b. silicon particle size c. purity levels of the raw materials d. ramp rate to reaction temperature; and/or.

the silicon has a particle size greater than 0.5 mm; and/or the silicon has a particle size in the range 0.5 mm to 3 mm.

iii) A silicon carbide heating element having one or more hot zones and two or more cold ends, in which greater than 70% of the length of at least one cold end is coated with a conductive coating having an electrical resistivity lower than that of the material of the cold end; optionally in which:—.

greater than 80% of the length of the cold end is coated with the conductive coating; and/or greater than 90% of the length of the cold end is coated with the conductive coating; and/or the ratio between the metallised length of the cold end to the maximum dimension of the cold end transverse to the longest axis of the cold end is greater than 7:1; and/or the conductive coating is metallic; and/or the conductive coating comprises aluminium; and/or the metallic coating has a melting point above 1200° C.; and/or the metallic coating has a melting point above 1400° C.; and/or the metallic coating comprises nickel, chromium, iron, or mixtures thereof; and/or the conductive coating changes in composition along its length, the composition of the coating towards the hot zones having a greater stability at high temperature than the composition of the coating remote from the hot zones; and/or the coating is metallic comprising more than one metal type and in which the melting point of each metal type increases along the length of the cold end from a first end for connection to an electrical source towards a second end nearer the hot zones.

iv) A silicon carbide heating element as described above, in which the cross-sections of the cold ends at least for part of their length are less than the cross-sections of the hot zones optionally in which:—.

the element is tubular; and/or the cold ends have a narrower wall thickness than the hot zones; and/or the outer diameter of the cold ends is less than the outer diameter of the hot zone; and/or.

the cold ends are thinned or perforated at selected points; and/or the cold ends are thermally insulated; and/or the maximum dimension of the cold ends transverse to the longest axis of the cold ends is less than the maximum dimension of the one or more hot zones transverse to the longest axis of the one or more hot zones; and/or The invention having been thus described with reference to certain specific embodiments and examples thereof, it will be understood that this is illustrative, and not limiting, of the appended claims.

The invention claimed is:

1. A silicon carbide heating element comprising one or more hot zones and two or more cold ends each having cross-sectional areas, wherein:

the cross-sectional area of each cold end is, beginning from a cold end side nearest to one of the hot zones, less than the cross-sectional areas of the one or more hot zones; and at least part of each cold end comprises a body of unimpregnated recrystallized silicon carbide material coated with a conductive coating having an electrical resistivity lower than that of the recrystallized silicon carbide material.

2. A silicon carbide heating element as claimed in claim 1 in which the one or more hot zones consist of an unimpregnated recrystallized silicon carbide material.

3. A silicon carbide heating element as claimed in claim 2, in which the one or more hot zones and two or more cold ends are a unitary body formed from the same unimpregnated recrystallized silicon carbide material.

4. A silicon carbide heating element comprising one or more hot zones and two or more cold ends each having cross-sectional areas, wherein:

the cross-sectional areas of each cold end is, beginning from a cold end side nearest to one of the hot zones, the same or less than the cross-sectional areas of the one or more hot zones;

at least part of each cold end comprises a body of unimpregnated recrystallized silicon carbide material coated with a conductive coating having an electrical resistivity lower than that of the recrystallized silicon carbide material; and in which each cold end is adjacent to one of the hot zones and further comprises one or more regions of silicon carbide material having a lower electrical resistivity than that of the unimpregnated recrystallized silicon carbide material, interposed between the unimpregnated recrystallized silicon carbide material of the cold end and the adjacent hot zone.

5. A silicon carbide heating element as claimed in claim 4, in which the region of silicon carbide material having a lower electrical resistivity comprises a silicon impregnated silicon carbide material.

6. A silicon carbide heating element as claimed in claim 1, wherein the conductive coating is metallic.

7. A silicon carbide heating element as claimed in claim 6, in which the conductive coating comprises aluminium.

8. A silicon carbide heating element as claimed in claim 6, in which the metallic coating has a melting point above 1200° C.

9. A silicon carbide heating element as claimed in claim 8, in which the metallic coating has a melting point above 1400° C.

10. A silicon carbide heating element as claimed in claim 9, in which the metallic coating comprises nickel, chromium, iron, or mixtures thereof.

11. A silicon carbide heating element as claimed in claim 1, wherein the conductive coating changes in composition along its length, the composition of the coating towards the hot zones having a greater stability at high temperature than the composition of the coating remote from the hot zones.

12. A silicon carbide heating element as claimed in claim 11, in which the coating is metallic comprising more than one metal type and in which the melting point of each metal type increases along the length of the cold end from a first end for connection to an electrical source towards a second end nearer the hot zones.

13. A silicon carbide heating element as claimed in claim 4, wherein the conductive coating is metallic.

14. A silicon carbide heating element as claimed in claim 13, in which the conductive coating comprises aluminium.

15. A silicon carbide heating element as claimed in claim 13, in which the metallic coating has a melting point above 1200° C.

16. A silicon carbide heating element as claimed in claim 15, in which the metallic coating has a melting point above 1400° C.

17. A silicon carbide heating element as claimed in claim 16, in which the metallic coating comprises nickel, chromium, iron, or mixtures thereof.

18. A silicon carbide heating element as claimed in claim 4, wherein the conductive coating changes in composition along its length, the composition of the coating towards the hot zones having a greater stability at high temperature than the composition of the coating remote from the hot zones.

19. A silicon carbide heating element as claimed in claim 18, in which the coating is metallic comprising more than one metal type and in which the melting point of each metal type increases along the length of the cold end from a first end for connection to an electrical source towards a second end nearer the hot zones.

* * * * *